United States Patent [19]

Langen

[11] Patent Number: 4,694,539

[45] Date of Patent: Sep. 22, 1987

[54] METHOD AND DEVICE FOR EXCHANGING EMPTY CANS WITH CANS FILLED WITH SLIVER

[75] Inventor: Manfred Langen, Mönchengladbach, Fed. Rep. of Germany

[73] Assignee: W. Schlafhorst & Co., Mönchengladbach, Fed. Rep. of Germany

[21] Appl. No.: 829,534

[22] Filed: Feb. 14, 1986

[30] Foreign Application Priority Data

Feb. 16, 1985 [DE] Fed. Rep. of Germany ..... 3505494

[51] Int. Cl.[4] ..... B65H 67/02

[52] U.S. Cl. ..... 19/159 A

[58] Field of Search ..... 19/159 R, 159 A

[56] References Cited

U.S. PATENT DOCUMENTS 4,059,185 11/1977 Weber ..... 19/159 A

*Primary Examiner*—Louis K. Rimrodt

*Attorney, Agent, or Firm*—Herbert L. Lerner; Laurence A. Greenberg

[57] ABSTRACT

A method of exchanging empty cans with cans filled with sliver at a spinning machine having set locations for the cans wherein a mobile transport device is automatically driven along a floorlike travel path at the spinning machine includes placing empty cans on the travel path, successively placing filled cans entrained with the transport device automatically at set locations of the machine which are unoccupied, picking up the empty cans on the travel path automatically with the transport device, and driving the transport device automatically back to a loading station, when the transport device is too full to pick up any more cans, so as to surrender the empty cans and pick up filled cans at the loading station preparatory to driving the transport device back to the spinning machine.

14 Claims, 4 Drawing Figures

METHOD AND DEVICE FOR EXCHANGING EMPTY CANS WITH CANS FILLED WITH SLIVER

The invention relates to a method and device for exchanging empty cans with cans filled with sliver at a spinning machine having set locations for the cans wherein a mobile transport device is automatically driven along a floorlike travel path at the machine.

In spinning machines, operating at the present time, the cans are conventionally changed manually during operation. In this regard, a respective adequately large servicing aisle or corridor is required at the machine or between mutually adjacent machines. Can transport and exchange of cans by hand are complicated and time-consuming and require considerable effort.

It is accordingly an object of the invention to provide a method and device for exchanging empty cans with cans filled with sliver wherein the exchange is simplified, automated and accelerated, taking into account that the advantages of the invention are not only applicable to new installations, but rather, also for machines which have already been in operation.

It is also an object of the invention to provide such a new device or retrofit a conventional device as well as provide such a new method or suitably revise conventional methods without any major inconvenience and cost.

With the foregoing and other objects in view, there is provided, in accordance with the invention, a method of exchanging empty cans with cans filled with sliver at a spinning machine having set locations for the cans wherein a mobile transport device is automatically driven along a floorlike travel path at the spinning machine, which comprises placing empty cans on the travel path, successively placing filled cans entrained with the transport device automatically at set locations of the machine which are unoccupied, picking up the empty cans on the travel path automatically with the transport device, and driving the transport device automatically back to a loading station, when the transport device is too full to pick up any more cans, so as to surrender the empty cans and pick up filled cans at the loading station preparatory to driving the transport device back to the spinning machine.

In accordance with another aspect of the invention, there is provided a device for performing a method of exchanging empty cans with cans filled with sliver at a spinning machine having set locations for the cans comprising a mobile transport device automatically drivable along a floorlike travel path at the spinning machine, the mobile transport device having first means for recognizing the presence of an empty can on the travel path, and a loading device for empty cans entrained with the mobile transport device and cooperatively associated with the first recognizing device; and having second means for recognizing the presence or absence of a can at the set locations, and an unloading device for filled cans entrained with the transport device and cooperatively associated with the second recognizing device.

When exchanging cans, it is necessary only to place the empty cans at set locations so that the mobile transport device recognizes each individual can and then automatically meets the individual requirements or conditions for loading the cans and finally for transporting them away. Unoccupied set locations for the cans are recognized or detected by the transport device automatically which is then able to place a filled can again at each individual unoccupied set location.

In accordance with another feature of the device of the invention, the loading device has a double-armed, pivotable can gripper.

In order for this can gripper to be able to place an empty can into an upright position, after it has been seized, so that it may be lifted and placed onto the transport device, in accordance with a further feature of the invention, the pivotable arms of the can gripper are provided with parallel guides for can holder shells. The can holder shells can hug the can wall and can engage, for example, under the bead-like upper margin or edge of the can.

In accordance with an added feature of the invention, the unloading device located on the mobile transport device has a can gripping device, a can lifting device and a horizontally mobile lever arm or boom. The individual operations of the unloading process are performed by a respective special device so that the entire unloading process is relatively simple to control, and requires only relatively simple equipment.

In accordance with another feature of the invention, the transport device is formed with a common set surface for both filled and empty cans. With a common set surface, the space which is available is better utilized than with separate set surfaces.

In accordance with a further feature of the invention, the common set surface is inclined from front to rear thereof in travel direction of the transport device and, even more specifically in accordance with the invention, the set surface is formed by mutually adjacent rotatably mounted rollers. This has the advantage that empty cans loaded at the front of the set surface roll or slide from front to rear either by themselves or merely by applying a relatively slight force thereto, so that they even entrain filled cans and deliver them, respectively, to a defined rear unloading position from which they then can be unloaded successively.

For this reason, in accordance with an added feature of the invention, the loading device for empty cans is arranged advantageously in the front of the set surface, as viewed in travel direction of the transport device, and the unloading device for filled cans is arranged in the rear thereof as viewed in the direction of travel.

In accordance with an additional feature of the invention and in order to prevent any disruptions due to overloading, there are provided means for permitting the loading device, which is normally blocked from loading, to load empty cans on the transport device only when the unloading device has unloaded a filled can from the transport device. In this regard, it is moreover possible to seize an empty can and lift it before a filled can is unloaded and, thereby, save space, while nevertheless the loading per se is prevented and blocked.

In accordance with yet another feature of the invention the first means for recognizing the presence of a can on the travel path have means for controlling the loading device.

In accordance with yet a further feature of the invention, means are included for driving the transport device which are controllable by the first means for recognizing the presence of an empty can on the travel path and by the second means for recognizing the presence or absence of a can at the set locations.

If the first recognizing means recognizes, for example, an empty can disposed on the travel path, the transport device travels to the vicinity of this can and then remains standing there so that the can is loaded while the transport device is stopped. Thereafter, the transport device travels on farther in the original travel direction. If the second recognizing means recognize, for example, an unoccupied set location, the transport device then remains standing near this set location, and the unloading device fills up the set location with a filled can entrained with the transport device. Thereafter, the transport device travels on farther in the original travel direction. In accordance with yet an added feature of the invention, the second means for recognizing the presence or absence of a can at the set locations have means for controlling the unloading device.

The instant a situation arises wherein the load capacity has reached its maximum and no further cans can be loaded anymore, the transport device should travel back by the fastest way to a loading station in order to deliver the empty cans and receive filled cans. In this regard, in accordance with a concomitant feature of the invention, means are included for driving the transport device, these driving means being automatically adjustable for driving the transport device in reverse travel direction the instant a can disposed on the travel path is recognized by the first recognizing means yet cannot be loaded because the load capacity of the transport would otherwise be exceeded.

The unloading of empty cans by the unloading device is prevented due to the fact that the unloading device is securely programmed to perform as many unloading operations as the number of filled cans have space on the loading surface. The instant all of the filled cans are unloaded, the possibility is afforded to the transport device to travel back immediately by the fastest way to the loading station to pick up filled cans thereat. For such a case, provision should be made that the drive means, after termination of the last unloading operation, is automatically set immediately for return travel. Because, under certain circumstances, the load capacity is not entirely utilized, however, and additional space may exist for empty cans, further travel in the original travel direction can be enabled after the last unloading operation. The transport device, in this case, travels back again to the loading station only if its loading surface has been loaded with empty cans and, if necessary or desirable, picks up and carries yet another empty can without placing this can on the loading surface.

Other features which are considered as characteristic for the invention are set forth in the appended claims.

Although the invention is illustrated and described herein as embodied in a method and device for exchanging empty cans with cans filled with sliver, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
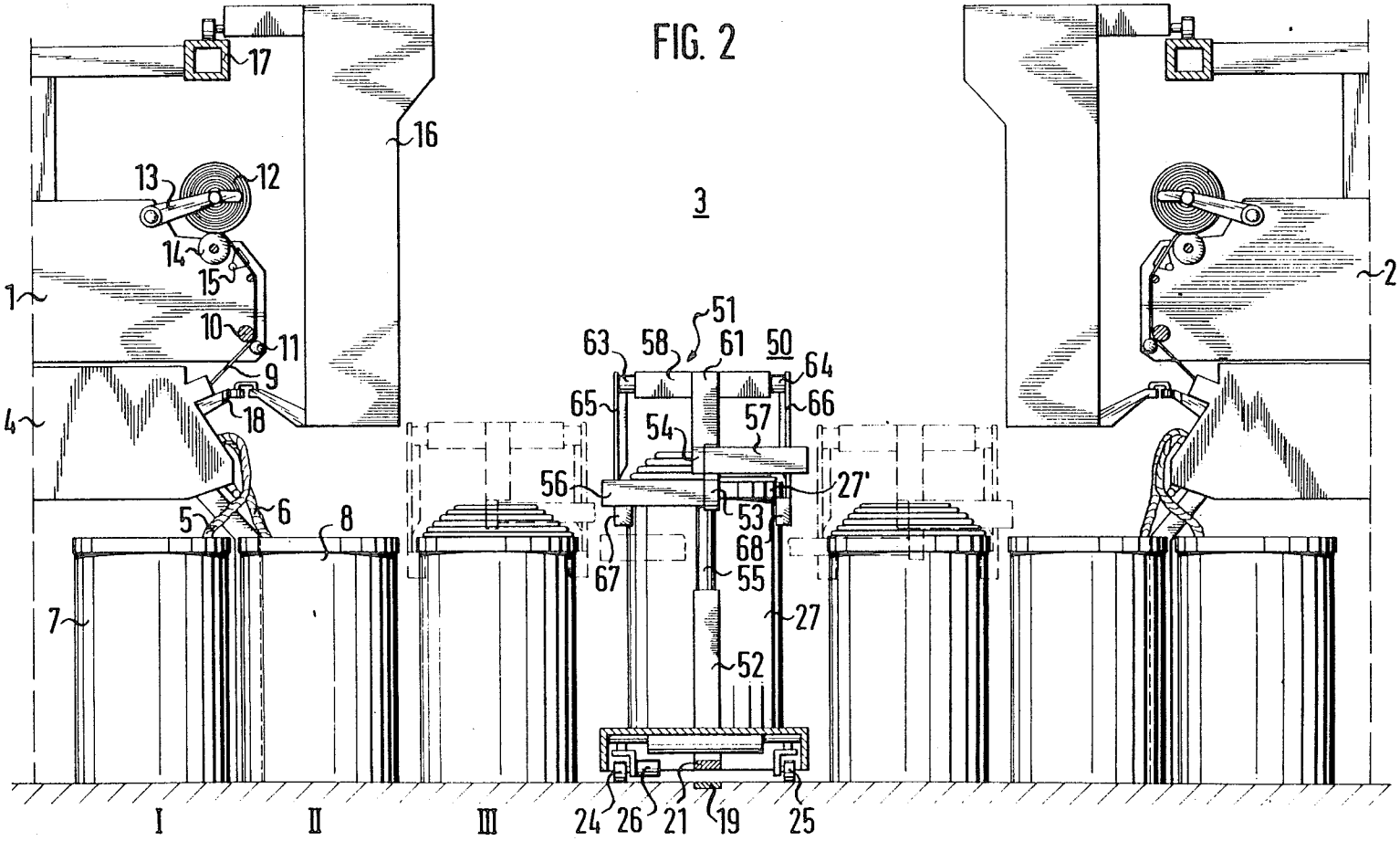
FIG. 2 is a partly diagrammatic rear elevational view of the can exchanging device of FIG. 1 in installed position between two spinning machines and facing in travel direction thereof into the plane of the drawing.
Figure 4:
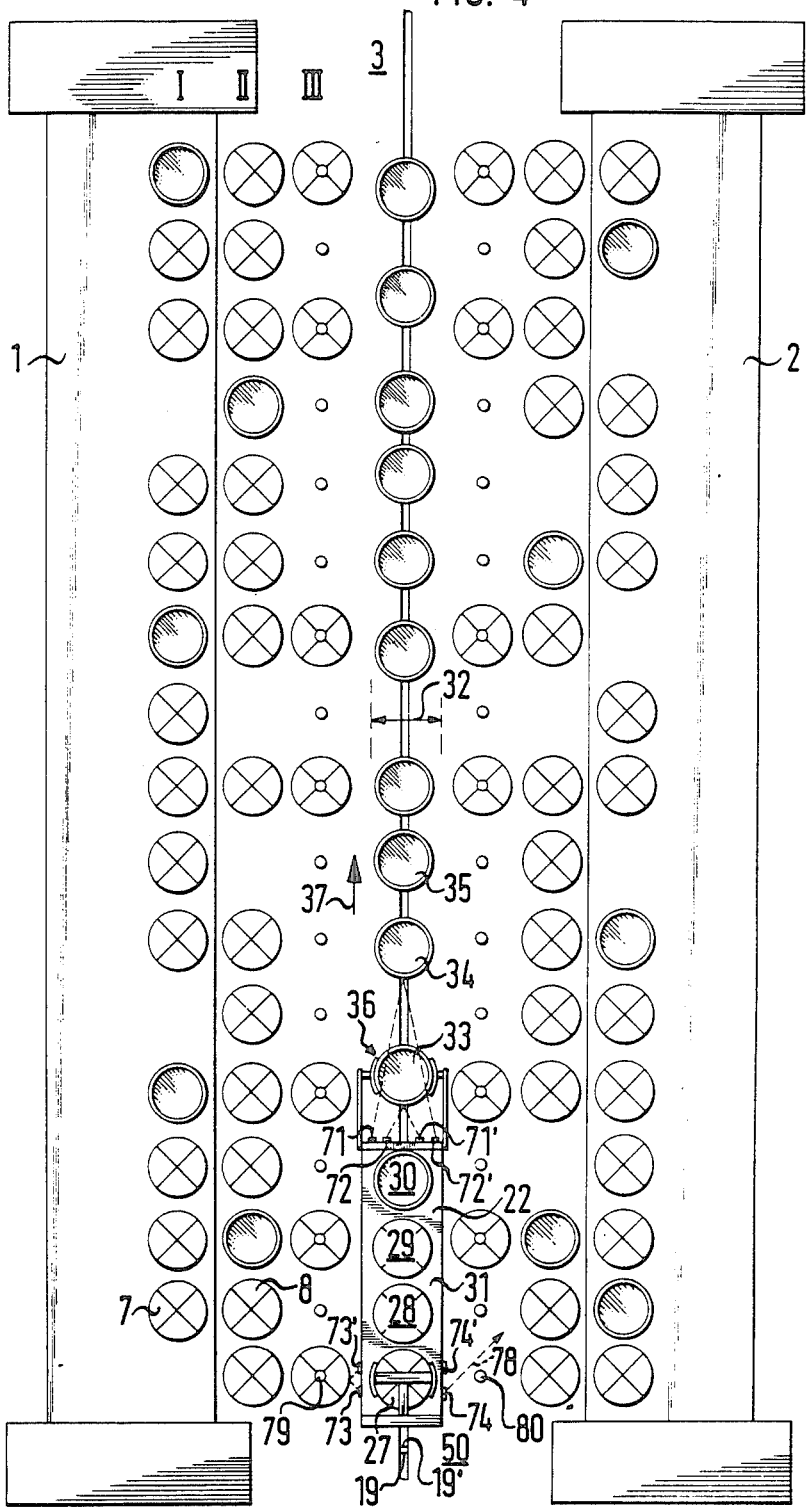
FIG. 4 is a much reduced, highly diagrammatic top plan view of FIG. 2.

Referring now to the drawing and first, particularly, to FIGS. 2 and 4 thereof, there are shown two spinning machines 1 and 2 disposed on a level floor. A servicing passage or corridor 3 is located between the spinning machines 1 and 2.

Both spinning machines 1 and 2 are of similar construction and include a multiplicity of spinning stations on both sides thereof, respectively, which are described hereinafter with respect to the spinning machine 1 according to FIG. 2, by way of example.

As shown in FIG. 2, sliver 5 runs into a spinning box 4 from a can 7, for example. A sliver 6 runs into a spinning box of a next-following spinning station located behind the spinning box 4, the sliver 6 originating, for example, from a can 8.

In the spinning box 4, the sliver 5 is spun into a thread 9 which is continuously drawn-off by a draw-off or take-up roller pair 10, 11 and fed to a rotating crosswound coil or cheese 12. The crosswound coil 12 is pivotally mounted in a package cradle or creel 13, lies on and is driven by a rotating drum 14. A reciprocating thread guide 15 provides for the lay of the thread in crosswound layers.

A traveling piecing or joining and cleaning device 16 can travel on a rail 17 and along a support rail 18 from spinning station to spinning station and perform the joining or piecing and cleaning operations.

Under the floor, there is located a guide rail 19 formed of magnetically conductive material, the guide rail 19 acting upon two induction devices 20 and 21 so as to hold a mobile transport device 22 on course. The induction device 20 is linked to two forward rollers 23, and the induction device 21 to rear rollers 24 and 25. The roller 24 is drivable by a battery-driven motor 26.

FIGS. 2 and 4 reveal that the cans 7, 8, and other cans, respectively, are disposed in three rows I, II and II. Filled cans are represented by a cross. The sliver runs out of the rows I and II into the individual spinning boxes. Filled reserve cans are in the row III. Individual set locations for reserve cans are represented by small circles.

FIG. 4 shows that not all of the set locations 56 are occupied by cans, and that the transport device 22 is, in fact, engaged in sequentially unloading cans 27, 28 and 29 filled with sliver and placing them on free set locations. To the extent that locations become free on the set surfaces 31 thereof, the transport device 22 loads empty cans 33, 34, 35 and so forth on a travel strip 32 consecutively until the entire set surface 31 is filled with empty cans and a further empty can is seized by a loading device 36 and lifted. The transport device 22 then travels with four empty cans on a given travel strip opposite to the direction represented by the arrow 37 back to an otherwise non-illustrated loading station where it surrenders the empty cans and receives filled cans.

FIG. 4 shows that an empty can 30 is located on the set surface 31 adjacent the three filled cans 27, 28 and 29 and that the empty can 33 has, in fact, been seized by the loading device 36.

Figure 1:
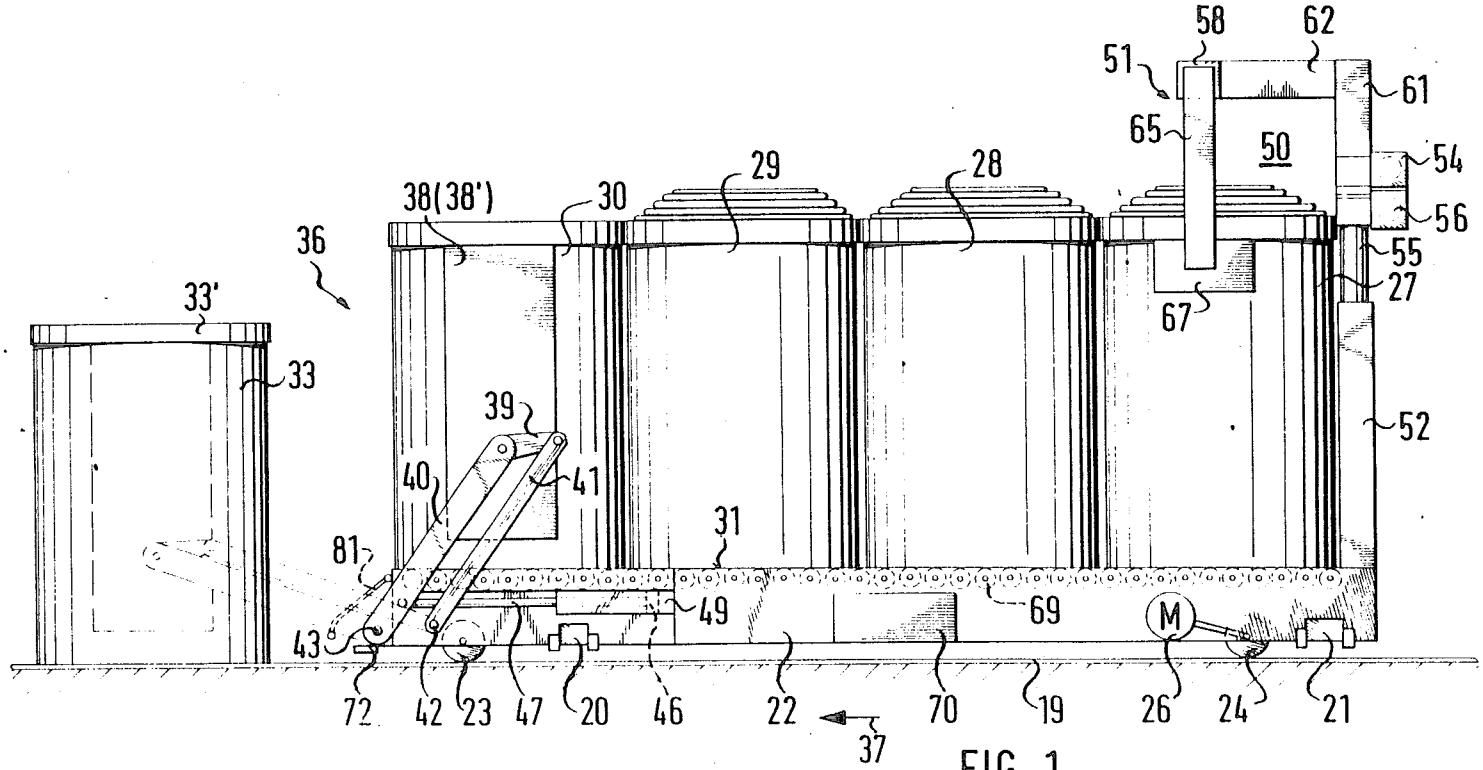
FIG. 1 is a partly diagrammatic side elevational view of a device for exchanging empty cans with cans filled with sliver in accordance with the invention.
Figure 3:
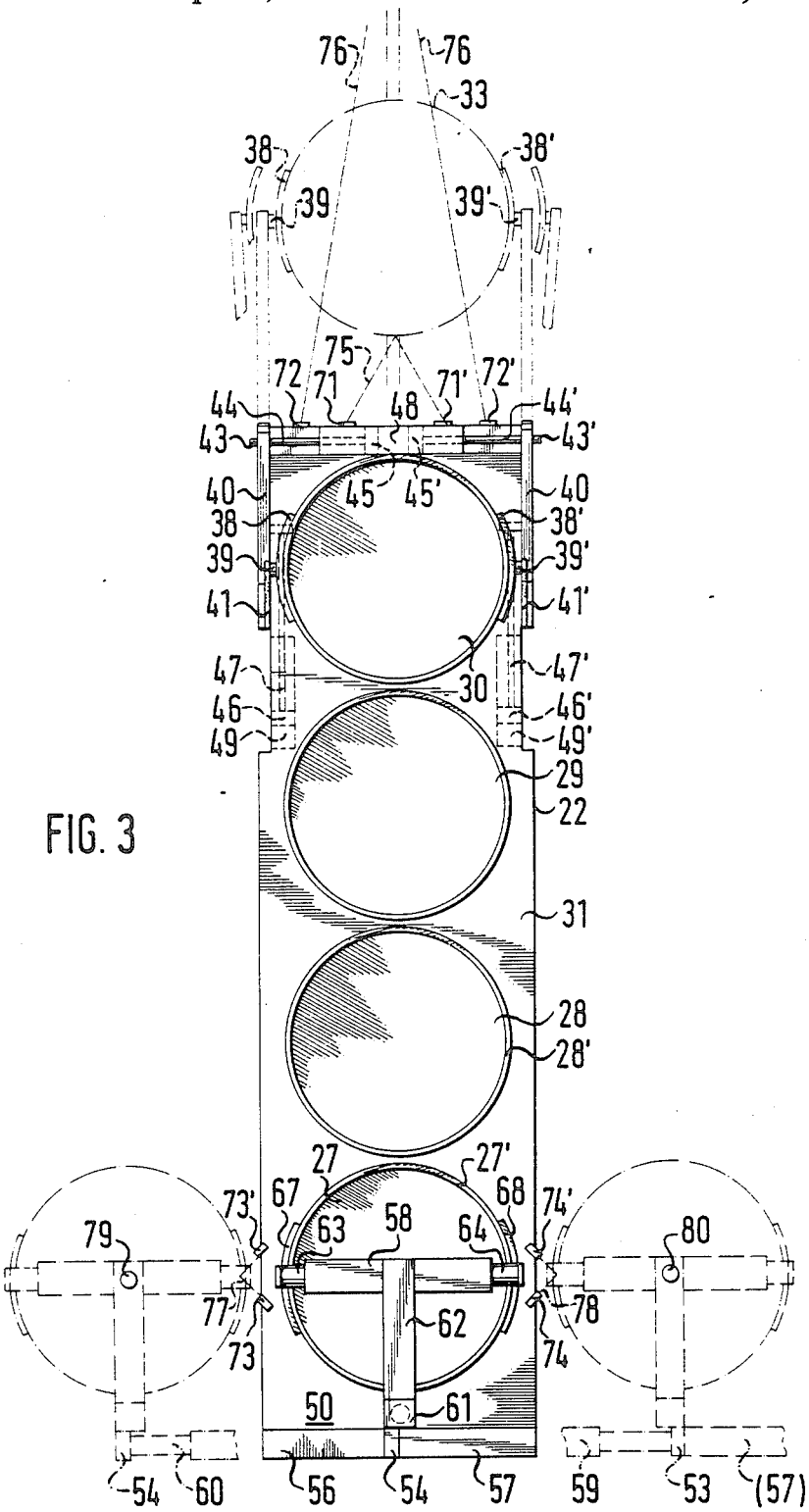
FIG. 3 is a top plan view of FIG. 2 showing the can exchanging device.

Further details of the transport device 22 are shown in FIGS. 1 to 3.

The loading device 36 is located on the transport device 22 frontwards in the direction of travel represented by the arrow 37. It has a double-armed, pivotable can gripper 38, 38' formed of two shells which are fastened to levers 39 and 39', respectively. The levers 30 and 39' are, respectively, part of a four-bar linkage and serve concurrently as parallel guides for pivotable arms 40, 41 and 40' and 41', respectively, of the can gripper 38, 38'. A pivot point 42 of the arm 41 is located on the housing of the transport device 22. A pivot point 43 of the arm 40 is located, on the other hand, at the end of a piston rod 44 of a piston 45 of an hydraulic cylinder 48 which is fastened to the housing of the transport device 22. The same applies to the arms 40', 41' of the can gripper 38' located on the opposite side whereon, for example according to FIG. 4, the pivot point 43' of the arm 40' is located on a second piston rod 44' of the piston 45' located in the same cylinder 48.

A piston 46 having a piston rod 47 articulatingly connected to the arm 41 is located on the left-hand side of the transport device 22, as viewed in FIG. 3, for swinging the arm 41. The arm 41' can be moved by a corresponding piston rod 47' belonging to a corresponding piston 46'. The piston 46 is located in a cylinder 49, and the piston 46' in a cylinder 49'.

At the rear end of the transport device 22, there is an unloading device 50 which has a can gripping device 51, a can lifting device 52 and two horizontally drivable lever arms or booms 53 and 54.

The can lifting device 52 is formed of an hydraulic cylinder having a piston rod 55 carrying another hydraulic cylinder 56. The lever arm 53 sits at an end of a telescopic piston 59 of the hydraulic cylinder 56. The lever arm 53 is rigidly connected to another hydraulic cylinder 57 which has a telescopic piston 60 carrying the lever arm 54. According to FIGS. 1 and 2, the lever arm 54 is rigidly connected to a connecting tube 61 which carries another hydraulic cylinder 58 via a bridge 62. The hydraulic cylinder 58 belongs to the can gripping device 51. Both of the piston rods 63 and 64 of the hydraulic cylinder 58 carry vertically downwardly extending holders 65 and 66, respectively, having respective holder shells 67 and 68 at the ends thereof.

The instant the hydraulic cylinder 56 is subjected to pressure oil, the lever arm 53 can be extended to the position thereof shown at the right-hand side of FIG. 3. It thus entrains the hydraulic cylinder 57 and parts connected thereto. If the hydraulic cylinder 57, as appears in the view thereof in FIG. 2, is subjected to pressure oil, the telescopic piston 60 thereof and the lever arm 54 therewith can be driven into the position thereof shown at the left-hand side of FIG. 3. The lever arm 54 entrains all of the parts connected thereto. The instant the hydraulic cylinder 58 is subjected to pressure oil, both of the piston rods 63 and 64 are driven out, entrain the holders 65 and 66, and thereby open the holder shells 67 and 68.

The set surface 31 of the transport device 22 is slightly inclined from the front towards the rear thereof and is formed by mutually adjacent, rotatably mounted rollers 69. Under the roller train 69, there is located a switching device 70 which contains therein non-illustrated conventional components for ensuring the coordination of the aforementioned devices, a current supply device for the motor 26 and an hydraulic oil supply device for the hydraulic cylinders. The operative connections extending from the switching device 70 have not been illustrated in the interest of clarity and simplification of the disclosure.

To recognize the cans standing on the travel path or strip and to recognize the presence or absence of cans on lateral or side set locations, the transport device 22 has several opto-electrical devices. Two opto-electrical devices are located in front under the cylinder 48, as viewed in direction of travel. The first device is formed of a light transmitter 71 and a light receiver 71' which converts an optical signal into an electrical signal. This is the case, the instant the transmitted light beam 75, for example, according to FIG. 3, is reflected at the can 33 so that it reaches the light receiver 71'. The second opto-electric device is formed of a light emitter 72 and a light receiver 72' which likewise transforms an optical signal into an electrical signal. This is the case when a transmitted light beam 76 is reflected at another can standing tin front of the can 33, as viewed in the travel direction, so that the reflected light beam 76 reaches the light receiver 72'. The third opto-electric device is formed of a light transmitter 73 located at the left hand rear, as viewed in the travel direction. The light receiver 73' is responsive if the transmitted light beam 77 is reflected at a can disposed in orderly manner on a set location 79 for a can. A similar opto-electrica device is located at the right-hand rear on the transport device 22. It is formed of a light transmitter 74 and a light receiver 74'. The light receiver 74' responds when a transmitted light beam 78 is reflected at a can disposed in orderly manner on a set location 80 for a can.

It is assumed with reference to FIG. 4, that the transport device 22 has received the three cans 27, 28 and 29 filled with sliver and was then driven along the guide rail 19 to the servicing corridor. It had initially travelled over a break or interruption 19' in the guide rail 19. This break 19' serves for the cylindrical control of both opto-electrical devices 73, 73' and 74, 74'. They should then always be measurement-ready when they are located near one of set locations for cans in the row III which are represented by small circles. Because the set locations are disposed adjacent one another at regular intervals, the measurement-readiness of the aforementioned opto-electrical devices can be controlled, for example, by the fact that the travel distance is subdivided, by automatic counting of the revolution of the travel rollers 23, 24, 25, into sections corresponding to the spacing between the set locations, starting from the break 19'. Whenever a corresponding path is travelled over, the opto-electrical devices receive a command to perform a measurement. The break 19' influences or affects the induction device 21, for example, in that it produces a change in the magnetic flux thereat, and this change in the magnetic flux is then the signal for starting the opto-electrical measurements.

It is assumed moreover, that the transport device 22 has already loaded an empty can 30 and seized another can 33 and lifted it up.

According to FIG. 4, the transport device 22 stands still while the opto-electrical device 74, 74' determines the absence of a can on the set location 80. Initially, the light receiver has enabled the immediate stoppage of the motor 26 via the switching device 70. Then, likewise enabled by the light receiver 74', the unloading device 50 is actuated. The switching device 70 successively or sequentially triggers the individual hydraulic cylinders. With reference to FIGS. 2 and 3, the unloading of the can filled with sliver occurs in the following manner:

Both of the piston rods 63 and 64 have already been driven in and the holder shells 67 and 68 engage under the upper margin 27' of the can 27. At first, the can lifting device 52 is subjected to pressure or actuated so as to drive the piston rod 55 out and lift the can 27 up from the set surface 31. The hydraulic cylinder 56 is then subjected to pressure oil so that the lever arm 53 is driven out to the right-hand end position thereof shown in FIG. 3. The lever arm 53 thus entrains the hydraulic cylinder 57, the telescopic piston 60 of which, in turn, carries the lever arm 54 which is connected to the connecting tube 61. Because the connecting tube 61 is connected to the hydraulic cylinder 58 via the bridge 62, the entire can gripping device with the can 27 is also brought to the side above the set location 80.

The foregoing is a description corresponding in substance to German Application No. P 35 05 494.8, dated Feb. 16, 1985, the International priority of which is being claimed for the instant application, and which is hereby made part of this application. Any material discrepancies between the foregoing specification and the aforementioned corresponding German application are to be resolved in favor of the latter.

I claim:

1. Method of exchanging empty cans with cans filled with sliver at a spinning machine having set locations for the cans wherein a mobile transport device is automatically driven along a floorlike travel path at the spinning machine, which comprises placing empty cans on the travel path, successively placing filled cans entrained with the transport device automatically at set locations of the machine which are unoccupied, picking up the empty cans on the travel path automatically with the transport device, and driving the transport device automatically back to a loading station, when the transport device is too full to pick up any more cans, so as to surrender the empty cans and pick up filled cans at the loading station preparatory to driving the transport device back to the spinning machine.

2. Device for performing a method of exchanging empty cans with cans filled with sliver at a spinning machine having set locations for the cans comprising a mobile transport device automatically drivable along a floorlike travel path at the spinning machine, said mobile transport device having first means for recognizing the presence of an empty can on the travel path, and a loading device for empty cans entrained with said mobile transport device and cooperatively associated with said first recognizing device; and having second means for recognizing the presence or absence of a can at the set locations, and an unloading device for filled cans entrained with the transport device and cooperatively associated with said second recognizing device.

3. Device according to claim 2 wherein said loading device has a double-armed, pivotable can gripper.

4. Device according to claim 3 wherein the pivotable arms of said can gripper have parallel guides for can holder shells.

5. Device according to claim 2 wherein said unloading device has a can gripping device, a can lifting device and at least one horizontally mobile lever arm.

6. Device according to claim 2 wherein said transport device is formed with a common set surface for both filled and empty cans.

7. Device according to claim 6 wherein said common set surface is inclined from front to rear thereof in travel direction of said transport device.

8. Device according to claim 6 wherein said set surface is formed by mutually adjacent rotatably mounted rollers.

9. Device according to claim 2 wherein said loading device for empty cans is disposed in front of said transport device as viewed in travel direction thereof, and said unloading device for filled cans is disposed in the rear of said transport device as viewed in travel direction thereof.

10. Device according to claim 2 including means for permitting said loading device to load an empty can on said transport device only when said unloading device has unloaded a filled can from said transport device.

11. Device according to claim 2 wherein said first means for recognizing the presence of a can on the travel path have means for controlling said loading device.

12. Device according to claim 2 including means for driving said transport device, said driving means being controllable by said first means for recognizing the presence of an empty can on the travel path and by said second means for recognizing the presence or absence of a can at the set locations.

13. Device according to claim 2 wherein said second means for recognizing the presence or absence of a can at the set locations have means for controlling said unloading device.

14. Device according to claim 2 including means for driving said transport device, said driving means being automatically adjustable for driving said transport device in reverse travel direction the instant a can disposed on the travel path is recognized by said first recognizing means yet cannot be loaded because the loading capacity of the transport device would otherwise be exceeded.

* * * * *